US006683251B1

(12) United States Patent
Brant et al.

(10) Patent No.: US 6,683,251 B1
(45) Date of Patent: Jan. 27, 2004

(54) PRESSURE PLATE FOR SWITCH OR RECEPTACLE

(75) Inventors: Edward Brant, Burlington, NC (US); John F. Myers, Liverpool, NY (US); Gerald R. Savicki, Jr., Syracuse, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 81 days.

(21) Appl. No.: 09/897,319

(22) Filed: Jun. 29, 2001

(51) Int. Cl.[7] ..... H01R 13/46

(52) U.S. Cl. ..... 174/53; 174/51; 174/57; 174/65 R; 174/40 CC; 174/35 R; 174/138 G; 220/3.7; 220/3.2; 439/801; 439/782; 439/781; 439/501; 24/115 R

(58) Field of Search ..... 174/53, 51, 57, 174/65 R, 40 CC, 35 R, 138 G; 220/3.7, 3.2; 439/801, 781, 782, 501; 24/115 R

(56) References Cited

U.S. PATENT DOCUMENTS

| | | | | | |
|---|---|---|---|---|---|
| 4,174,148 | A | * | 11/1979 | Obuch et al. | 411/160 |
| 4,424,405 | A | * | 1/1984 | Nattel | 174/53 |
| 4,630,015 | A | * | 12/1986 | Gernhardt et al. | 200/284 |
| 5,510,760 | A | * | 4/1996 | Marcou et al. | 335/18 |
| 5,866,844 | A | * | 2/1999 | Osterbrock et al. | 174/51 |
| 5,998,734 | A | * | 12/1999 | Kerestan et al. | 174/53 |

* cited by examiner

*Primary Examiner*—Dean A. Reichard
*Assistant Examiner*—Anton Harris
(74) *Attorney, Agent, or Firm*—Wall Marjama & Bilinski

(57) ABSTRACT

A pressure plate for an electrical device includes at least one internal standoff, at least one outboard standoff, and an anti-rotation leg. The internal and outboard standoffs prevent overtightening of the terminal screw. The anti-rotation leg preserves the orientation of the pressure plate and prevents a speed wire arm from being deformed when removing a speed wired wire from the device.

12 Claims, 6 Drawing Sheets

PRESSURE PLATE FOR SWITCH OR RECEPTACLE

FIELD OF THE INVENTION

This invention relates generally to the field of pressure plates used in electrical devices, and more particularly to a pressure plate which improves wire retention with a variety of wiring methods.

BACKGROUND OF THE INVENTION

Electrical device manufacturers are challenged with trying to offer several wiring methods to an installer of switches and receptacles while at the same time trying to maintain a small device. Hot, neutral, and ground conductors are affixed to an electrical device using one of three methods: side wiring, back wiring, and speed wiring. In side wiring, the bare end of the conductor is wrapped a half turn around a terminal screw post and the screw head is tightened, trapping the conductor between the screw head and the terminal. The conductor must be wrapped in a clockwise direction so that tightening the screw doesn't unwrap the conductor from the screw post. Back wiring is similar to side wiring except that a pressure plate is positioned between the screw head and the terminal. The bare end of the conductor is trapped between the pressure plate and the terminal as the screw is tightened. In speed wiring, the bare end of the conductor is inserted into a hole of the body of the switch or receptacle, where the conductor is captivated by a terminal spring arm.

Problems occur when trying to devise a pressure plate which accommodates all three types of wiring on a narrow body device.

SUMMARY OF THE INVENTION

Briefly stated, a pressure plate for an electrical device includes at least one internal standoff, at least one outboard standoff, and an anti-rotation leg. The internal and outboard standoffs prevent overtightening of the terminal screw. The anti-rotation leg preserves the orientation of the pressure plate and prevents a speed wire arm from being deformed when removing a speed wired wire from the device.

According to an embodiment of the invention, a pressure plate for an electrical device includes a flat portion, the flat portion having a hole centered therein; a first internal standoff adjacent the hole; an outboard standoff disposed at a first location on the flat portion; and an anti-rotation leg disposed at a second location on the flat portion.

DETAILED DESCRIPTION OF THE PREFERRED EMBODIMENT

Figures 1A, 1B:
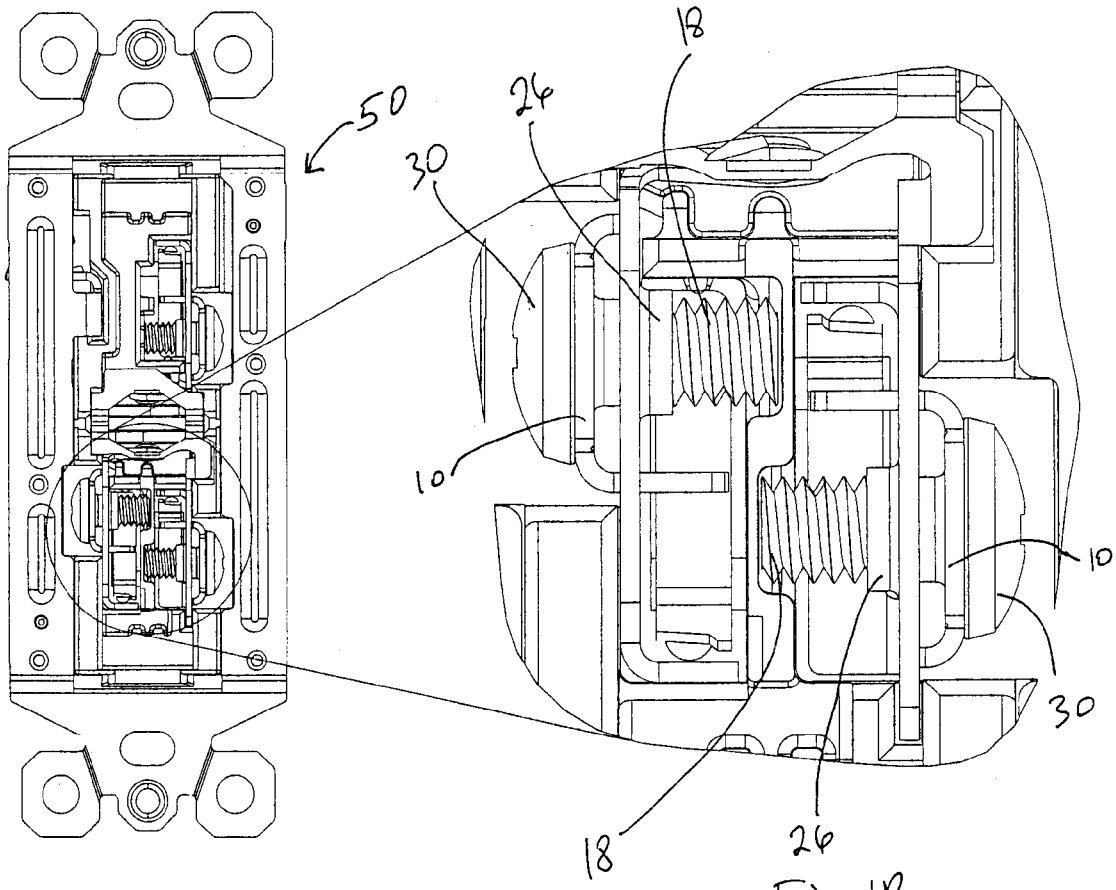
FIG. 1A shows a cross-sectional view of an electrical device.
FIG. 1B shows an enlarged view of a portion of FIG. 1A.
Figure 4A:
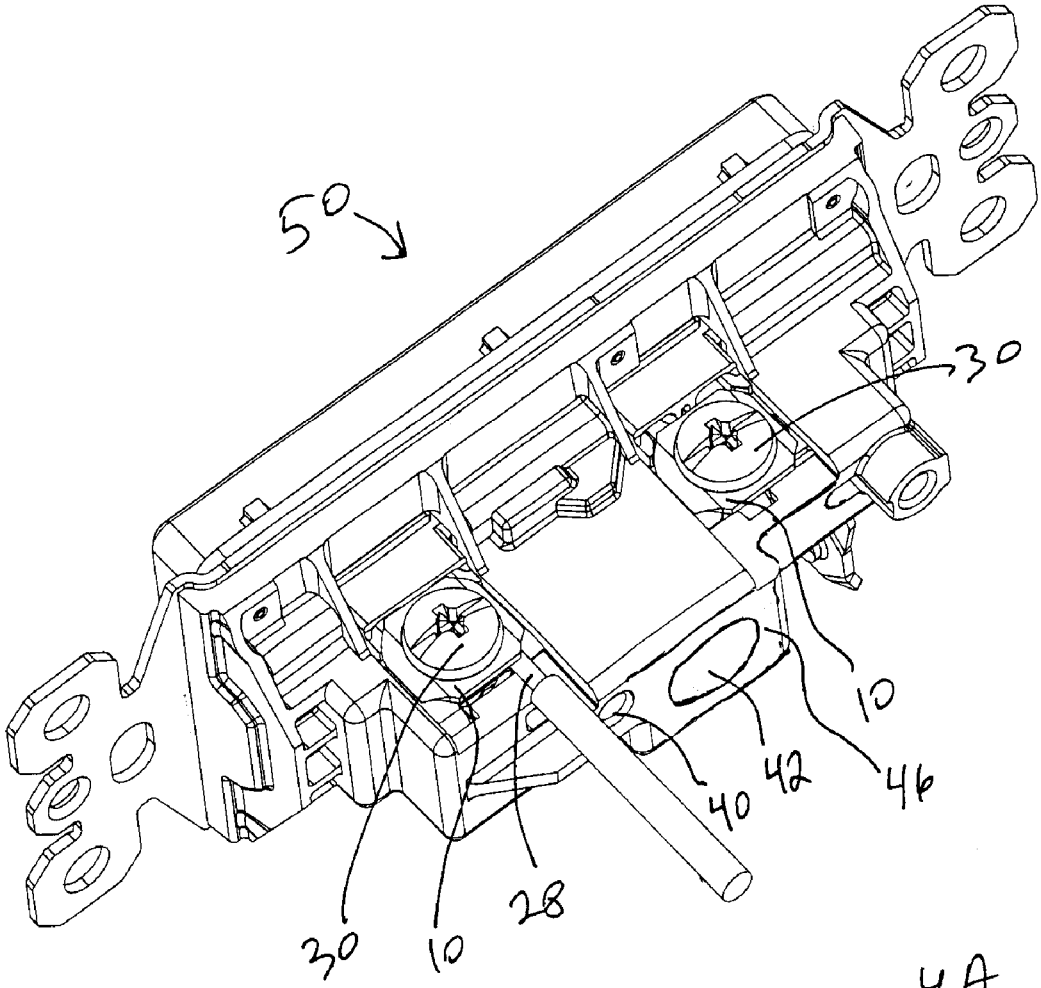
FIG. 4A shows the electrical device wired using back wiring.
Figure 4B:
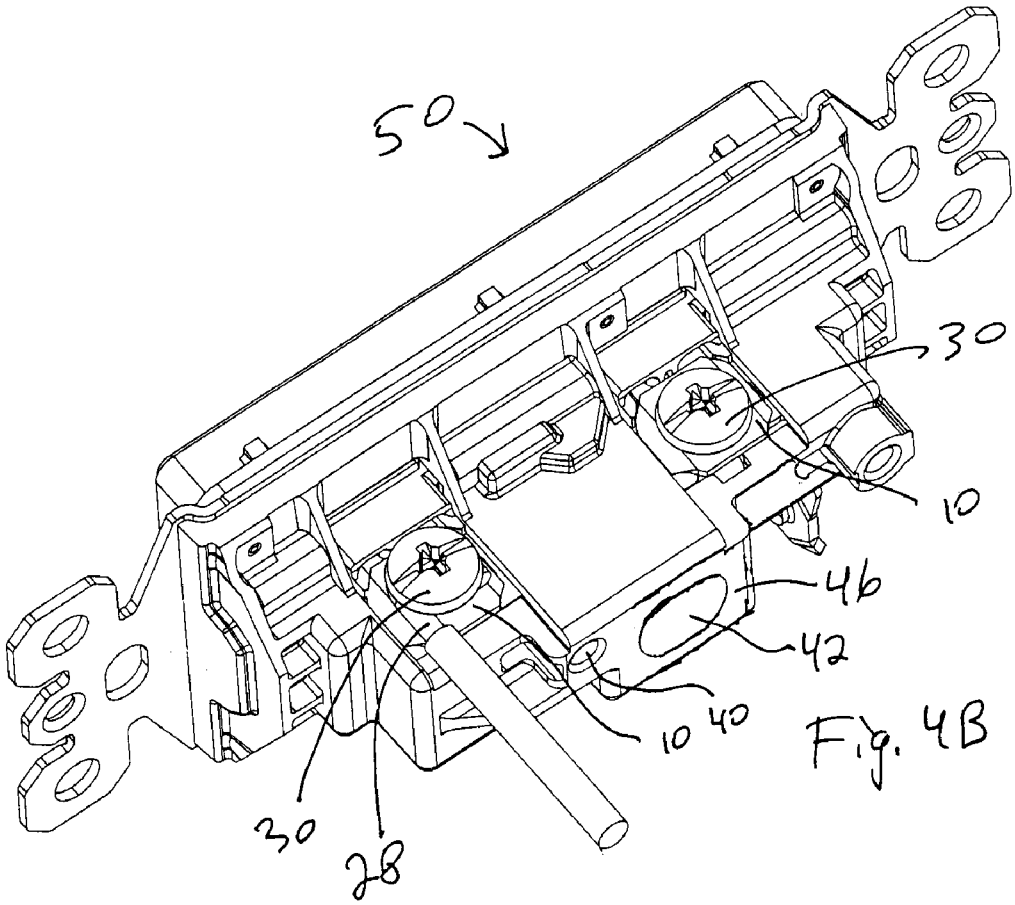
FIG. 4B shows the electrical device wired using side wiring.

Referring to FIGS. 1A–1B, a portion of an electrical device 50 such as a switch or receptacle is shown. A terminal post screw 18 screws into a terminal post 26 to captivate a conductor wire 28 (FIG. 4A) between a pressure plate 10 and a screw head as shown in FIGS. 4A and 4B.

Figure 2B:
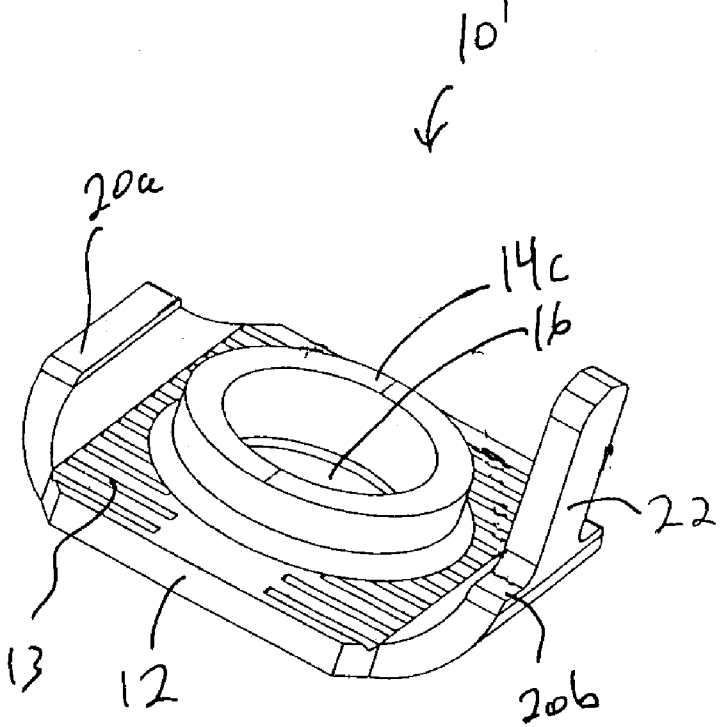
FIG. 2B shows a pressure plate according to an embodiment of the invention.
Figure 2A:
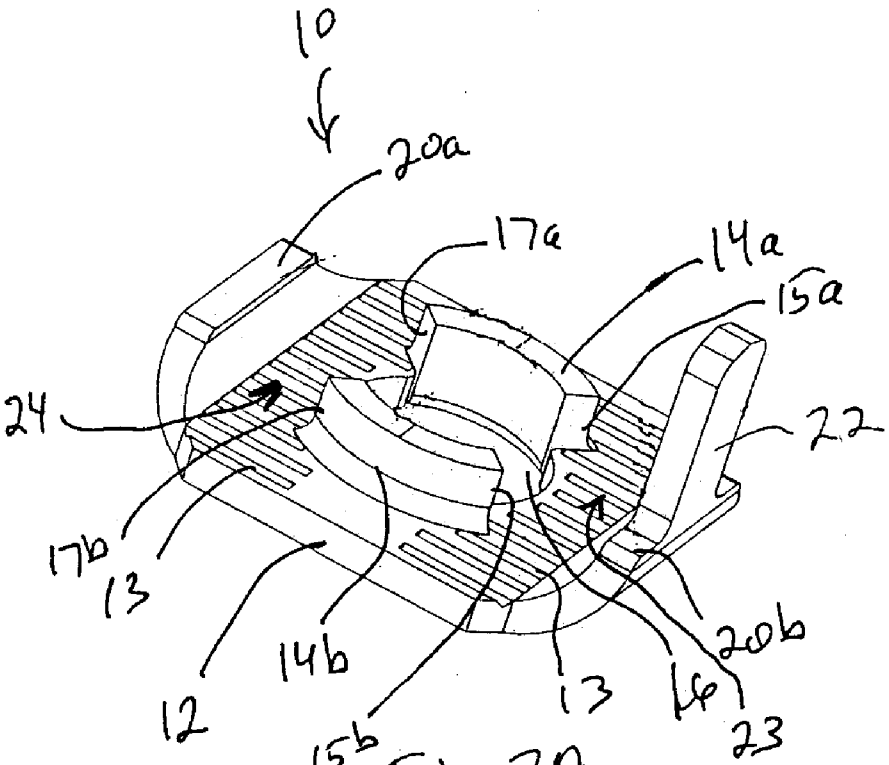
FIG. 2A shows a pressure plate according to an embodiment of the invention.

Referring also to FIG. 2A, pressure plate 10 includes a preferably square or rectangular captivation portion 12 so as to fit within the conventional structure for a device terminal. A plurality of shallow grooves 13 aid in gripping the conductor wire. Inboard standoffs 14*a*, 14*b* are preferably on opposite sides of a hole 16 for terminal post screw 18. Outboard standoffs 20*a*, 20*b* are preferably on opposite sides of captivation portion 12.

Inboard standoffs 14*a*, 14*b* are preferably opposing arcuate sections, with opposing ends 15*a*, 15*b* of inboard standoffs 14*a*, 14*b* together with outboard standoff 20*b* defining a passageway 23 for wire 28 on one side of hole 16 and opposing ends 17*a*, 17*b* of inboard standoffs 14*a*, 14*b* together with outboard standoff 20*a* defining a passageway 24 for wire 28 on the other side of hole 16.

The height for inboard standoffs 14*a*, 14*b* must be equal to or greater than the height for outboard standoffs 20*a*, 20*b*, with the preferable height for inboard standoffs 14*a*, 14*b* is equal to the height of outboard standoffs 20*a*, 20*b*. An anti-rotation leg 22 further extends from outboard standoff 20*b*.

Referring to FIG. 2B, an embodiment is shown for a pressure plate 10' in which the two inboard standoffs 14*a*, 14*b* are replaced by a single inboard standoff 14*c*. This embodiment is easier to manufacture than the embodiment of FIG. 2A, but does not provide for passageways to facilitate back wiring.

Figure 4C:
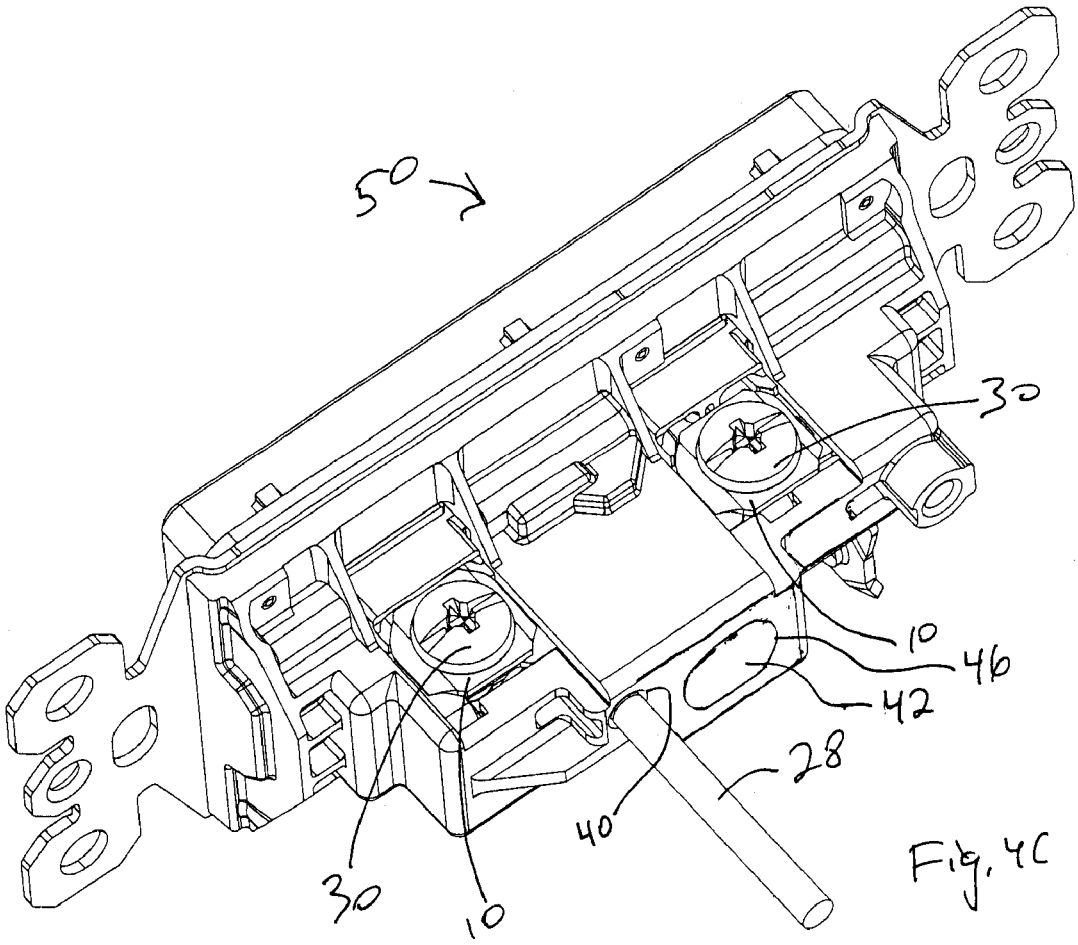
FIG. 4C shows the electrical device wired using speed wiring.

FIG. 4A shows back wiring, FIG. 4B shows side wiring, and FIG. 4C shows speed wiring.

Inboard standoffs 14*a*, 14*b* have three functions. The first function is wire alignment/captivation in that the conductor wire is aligned by one of passageways 23 and 24 which are formed on one side by part of internal standoffs 14*a*, 14*b*.

The second function is to prevent screw 18 from interfering with screws of opposite terminals when the terminal post screw 18 is fully tightened. This interference becomes a concern with a narrow body device as shown in FIG. 1B, where it can be seen that, in the absence of internal standoffs 14*a*, 14*b*, over-tightening one screw 18 can cause that screw 18 to penetrate too far into device 50 and make contact with the terminal on the other side.

The third function is to prevent terminal distortion during side wiring. The height of internal standoffs 14*a*, 14*b* is critical for preventing terminal distortion. Terminal distortion is of particular concern in switches with a terminal which contains a contact. If terminal distortion occurs, this affects contact location, thus making the switch inoperable.

Outboard standoffs 20*a*, 20*b* have two functions. The first function is wire alignment/captivation in that the conductor wire is aligned by one of passageways 23 and 24 which are formed on one side by part of outboard standoffs 20*a*, 20*b*. The second function is to act in cooperation with internal standoffs 14*a*, 14*b* to prevent terminal post screw 18 from interfering with opposite terminals when screw 18 is fully tightened, as explained above. The height of outboard standoffs 20*a*, 20*b* is also important. Too large a height prevents adequate gripping during back wiring, while too small a height causes gripping problems during back wiring.

Figure 3:
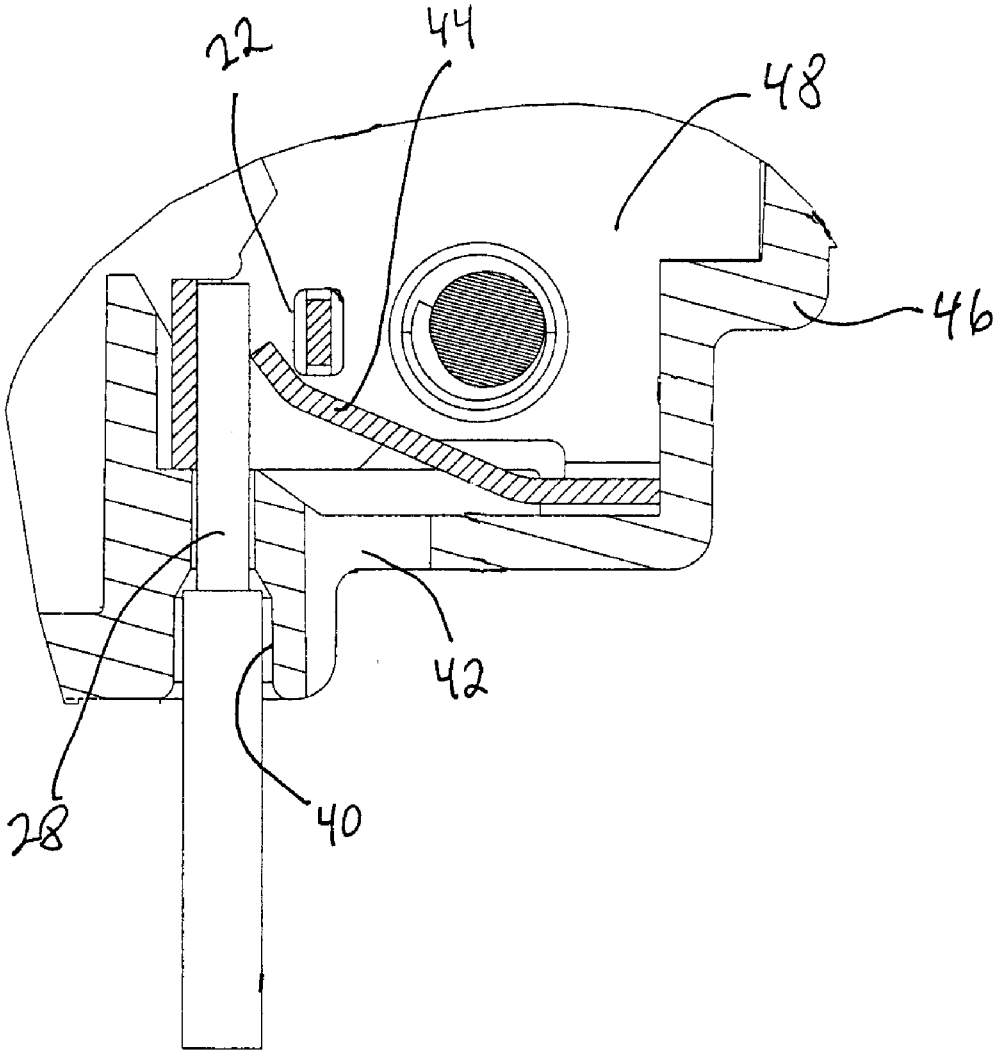
FIG. 3 shows a partial cross-sectional view of the electrical device showing the speed wiring portions of the electrical device.

Referring to FIG. 3, a partial cross-sectional view of the electrical device shows wire 28 inserted into a speed wire hole 40, where wire 28 makes contact with a speed wire arm 44. Speed wire arm 44 is part of terminal 48, so that wire 28 makes electrical contact with terminal 48 via speed wire arm 44. A speed wire release hole 42 is shown inside a body 46. To remove wire 28, one inserts a screwdriver into speed wire release hole 42 to force speed wire arm 44 away from wire 28, at which time wire 28 is pulled from speed wire hole 40.

Anti-rotation leg 22 has two functions. The first function of leg 22 is to maintain the orientation of pressure plate 10 by fitting into an opposing hole or recess in the terminal itself. The second function of leg 22 is to limit the travel of speed wire arm 44 so that speed wire arm 44 is not permanently deformed when removing wire 28. This permanent deformation can render the speed wire or feature inoperable, i.e., the speed wire or arm fails to grip the wire upon a second wire insertion.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A pressure plate for an electrical device, comprising:

a flat portion, said flat portion having a hole centered therein;

a first internal standoff adjacent said hole;

an outboard standoff disposed at a first location on said flat portion; and an anti-rotation leg disposed at a second location on said flat portion, wherein said anti-rotation leg fits into a corresponding recess in a terminal of said electrical device when said pressure plate is tightened against a wire inserted between said pressure plate and said terminal, said anti-rotation leg includes means for limiting travel of a speed wire arm of said device when removing a conductor wire from said device after said conductor wire has been connected to said electrical device using speed wiring.

2. A pressure plate according to claim 1, further comprising a second internal standoff adjacent said hole.

3. A pressure plate according to claim 2, further comprising a second outboard standoff disposed adjacent said second location on said flat portion.

4. A pressure plate according to claim 2, wherein said first and second internal standoffs are arcuate segments disposed opposite each other across said hole.

5. A pressure plate according to claim 4, wherein said segments of said first and second internal standoffs each have two ends, wherein a passageway for an electrical wire is defined by opposing ends of said segments on one side of said passageway and said anti-rotation leg on another side of said passageway.

6. A pressure plate according to claim 4, wherein said segments of said first and second internal standoffs each have two ends, wherein a passageway for an electrical wire is defined by opposing ends of said segments on one side of said passageway and said outboard standoff on another side of said passageway.

7. A pressure plate according to claim 5, wherein a second passageway for an electrical wire is defined by opposing ends of said segments on one side of said second passageway and said outboard standoff on another side of said passageway.

8. A pressure plate according to claim 1, wherein said first and second locations are on an edge of said flat portion on opposite sides of said hole.

9. A pressure plate according to claim 1, wherein said flat portion is substantially rectangular shaped.

10. A pressure plate for an electrical device, comprising:

a flat portion, said flat portion having a hole centered therein;

an internal standoff adjacent said hole, wherein said internal standoff is one-piece with said flat portion;

an outboard standoff disposed at a first location on said flat portion, wherein said outboard standoff is one-piece with said pressure plate; and an anti-rotation leg disposed at a second location on said flat portion, wherein said anti-rotation leg is effective for and disposed such that it limits travel of a speed wire arm of said device when removing a conductor wire from said device after said conductor wire has been connected to said electrical device using speed wiring.

11. A pressure plate for an electrical device in which a screw connects said pressure plate to a first terminal of said electrical device, comprising:

a flat portion, said flat portion having a hole centered therein;

inboard standoff means, one-piece with said flat portion, for aligning and captivating a conductor wire when said conductor wire is connected to said electrical device using back wiring, and for preventing distortion of said terminal caused by over-tightening said screw when said conductor wire is connected to said electrical device using side wiring;

outboard standoff means, working in cooperation with said inboard standoff means, for aligning and captivating said conductor wire when said conductor wire is connected to said electrical device using back wiring; and means for limiting travel of a speed wire arm of said device when removing said conductor wire from said device after said conductor wire has been connected to said electrical device using speed wiring.

12. A pressure plate according to claim 11, wherein said inboard standoff means and said outboard standoff means work in cooperation for preventing a screw post of said screw from interfering with a terminal disposed within said electrical device but disposed on an opposite side of said electrical device from said pressure plate.

* * * * *